US007043803B2

(12) United States Patent
Chen

(10) Patent No.: US 7,043,803 B2
(45) Date of Patent: May 16, 2006

(54) BONE-ASHES URN PRESERVING CASE

(76) Inventor: Feng-Kuei Chen, P.O. Box 90, Tainan City 704 (TW)

( * ) Notice: Subject to any disclaimer, the term of this patent is extended or adjusted under 35 U.S.C. 154(b) by 0 days.

(21) Appl. No.: 10/933,238

(22) Filed: Sep. 3, 2004

(65) Prior Publication Data

US 2006/0048352 A1 Mar. 9, 2006

(51) Int. Cl.
*A61G 17/00* (2006.01)

(52) U.S. Cl. ..... 27/1; 220/23.89; 220/732

(58) Field of Classification Search ..... 27/1, 27/19, 35; 211/85.27; 220/23.87, 23.89, 220/732, 632
See application file for complete search history.

(56) References Cited

U.S. PATENT DOCUMENTS 2,513,951 A * 7/1950 McClellen ..... 27/1
4,648,162 A * 3/1987 Daino ..... 27/1
5,349,727 A * 9/1994 Niebergall ..... 27/1
6,421,890 B1 * 7/2002 Biggar ..... 27/1
6,763,558 B1 * 7/2004 Mytych ..... 27/2
2004/0098846 A1 * 5/2004 Glass ..... 27/1
2005/0125973 A1 * 6/2005 Hankel et al. ..... 27/1

* cited by examiner

*Primary Examiner*—William L. Miller

(57) ABSTRACT

A bone-ashes urn preserving case includes a case body, a soft cushion and two positioning members. The case body has a chamber in its interior, and the soft cushion is attached on a rear wall of the case body, and the positioning members are respectively adhered on the inner surfaces of two opposite sidewalls of the case body. Each positioning members are made of soft plastic, shaped as a palm with five fingers, having an inner embrace surface for softly embracing two sides of a bone-ashes urn when it is placed in the chamber of the case body, with the soft cushion resting against the rear side of the urn. So the urn never sways or inclines in the case body even in case of an earthquake, always safely kept therein without possibility of getting any damage.

4 Claims, 5 Drawing Sheets

BONE-ASHES URN PRESERVING CASE

BACKGROUND OF THE INVENTION

1. Field of the Invention

This invention relates to a bone-ashes urn preserving case, particularly to one provided with cushions made of soft plastic and positioning members in the inside of a bone-ashes urn preserving case. The positioning members are respectively located on two sidewalls, having an inner side functioning as an embrace surface, an outer side functioning as an adhering surface to adhere on the surface of the two sidewalls. Then the two positioning members embrace the two sides of a bone-ashes urn, having an outer thick end for stopping the urn to move out so that the urn may be stabilized in the preserving case, permitting the soul of the deceased silently and calmly and seriously preserved in the urn, which will never be swayed, inclined to get damaged.

2. Description of the Prior Art

A conventional bone-ashes urn preserving case shown in FIG. 1 includes a case body 1 defining a chamber 11 for a bone-ashes urn to be placed therein, a faceplate 13 removably fixed at a front side of the case body 11 to prevent the urn from falling out of the case.

However, the conventional bone-ashes urn preserving case 1 has no structure of stabilizing the urn for preventing it from swaying or inclining in case of an earthquake or the preserving case collided by something accidentally. Therefore, the preserving urn may be swayed or inclined to be possible damaged, as a sign of disrespect to the deceased.

SUMMARY OF THE INVENTION

This invention has been devised to offer a bone-ashes urn preserving case provided with the anti-vibration function effected by two palm-shaped position members made of soft plastic adhered on two sidewalls of the case so as to preserve safely the bone-ashes urn for the purpose of calming the soul of the deceased.

The feature of the invention is two positioning members shaped as a palm with five fingers adhered on two inner sidewalls of a bone-ashes urn preserving case, and each positioning member has an inner embracing surface for holding immovably the urn and an outer adhering surface for adhering on the inner surface of each sidewall of the case to keep stably the positioning members in the case. Further, a soft cushion is adhered on an inner surface of a rear wall of the case to resiliently stop the rear side of the urn.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
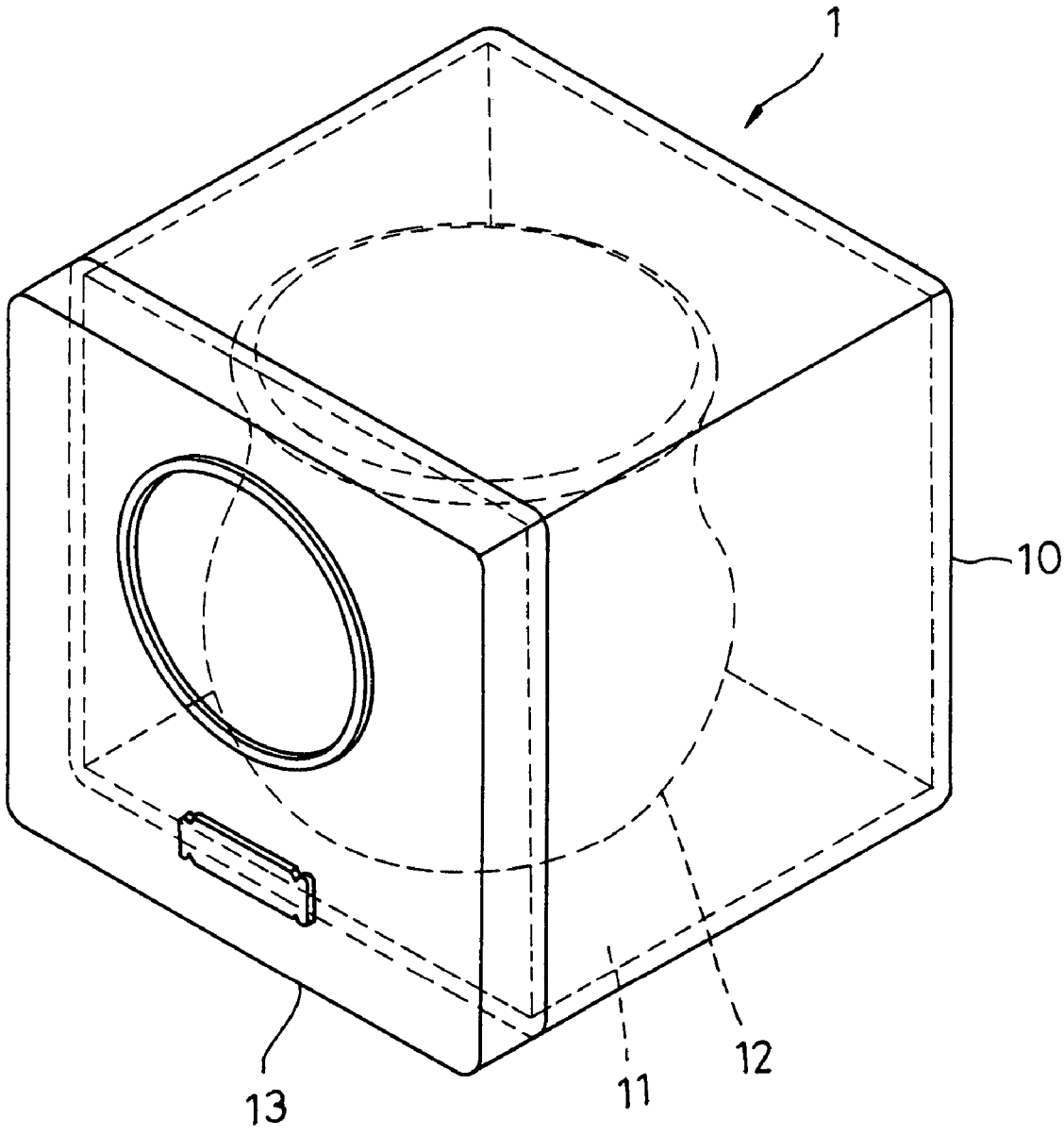
FIG.1 (PRIOR ART)
FIG. 1 is a perspective view of a conventional bone-ashes urn preserving case.
Figure 2:
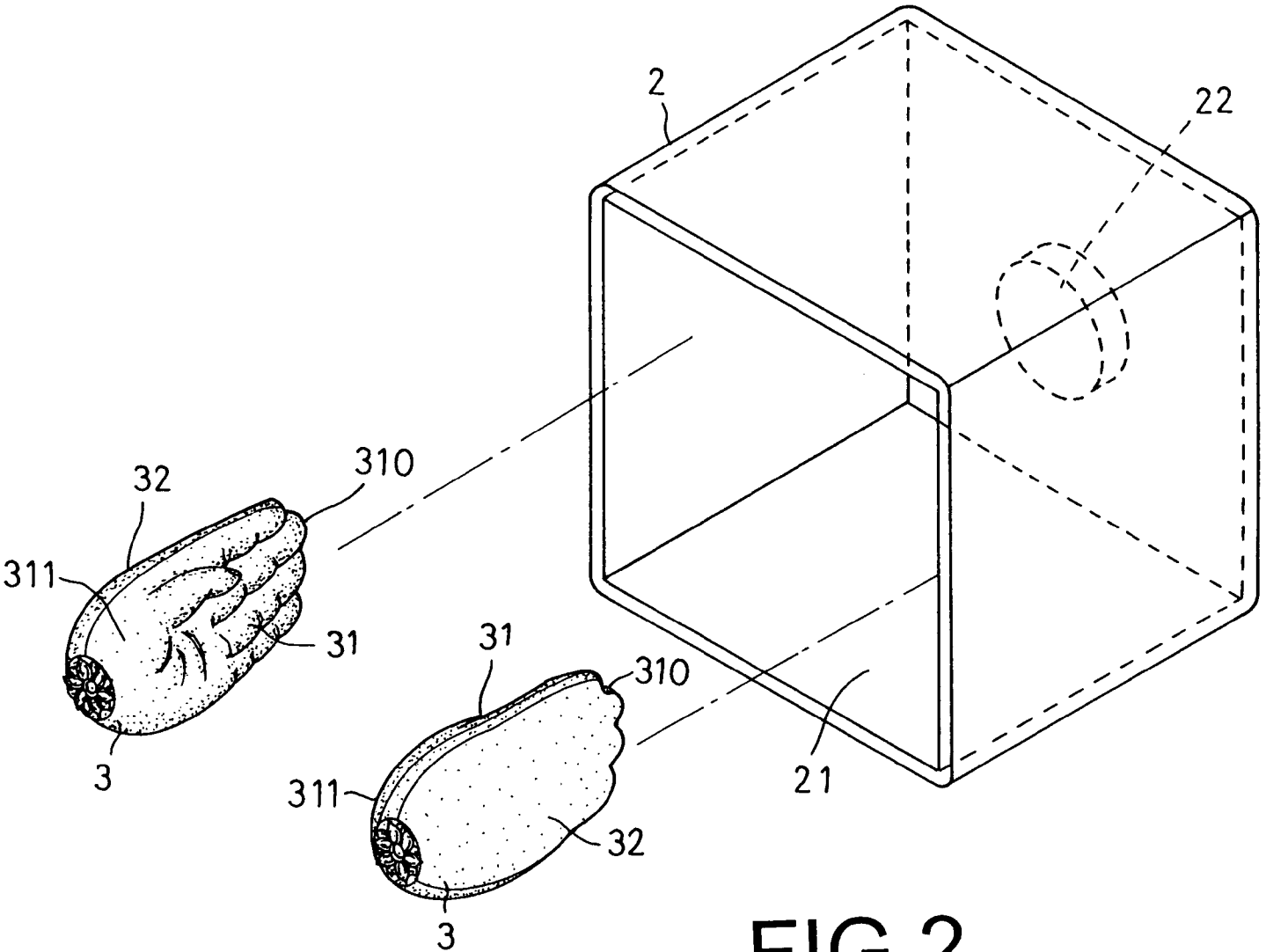
FIG. 2 is an exploded perspective view a first embodiment of a bone-ashes urn preserving case in the present invention.

A first embodiment of a bone-ashes urn preserving case in the present invention, as shown in FIG. 2, includes a case body 2, a chamber 21 defined by the case body 2, a soft cushion 22 made of soft flexible plastic adhered on an inner surface of a rear wall of the case body 2, two positioning members 3 adhered on an inner surface of two sidewalls of the base body 2, and a faceplate 13 to close up the front opening of the case body 2.

The two positioning members 3 are respectively shaped as a Buddha's thick palm with five fingers closely positioned and made of soft flexible plastic, symmetrically located and adhered on an inner surface of the two sidewalls of the case body 2 for embracing two sides of a bone-ashes urn with an embracing surface 31 formed in the inner side of each positioning member 3 with a thin finger portion 310 and a thick palm portion 311 to contact flexibly the two sides of a bone-ashes urn, and an adhering flat surface 32 formed in an outer surface for adhering on the inner surface of each sidewall of the case body 2.

Figure 3:
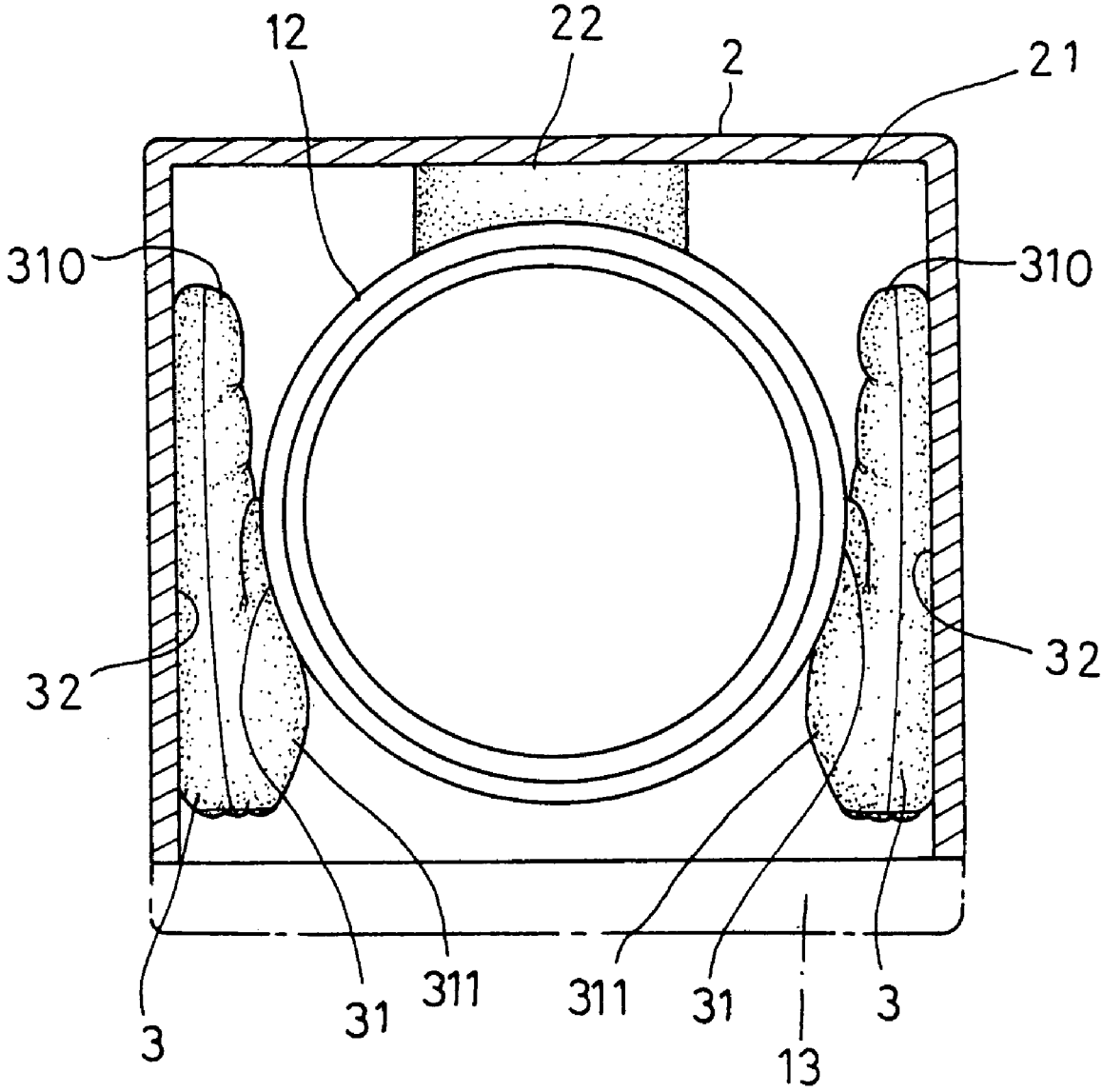
FIG. 3 is an upper view of the first embodiment of a bone-ashes urn preserving case in the present invention, showing a bone-ashes urn being kept therein.

In using, referring to FIGS. 2 and 3, a bone-ashes urn 12 is to be placed in the chamber 21 of the case body 2, with the rear surface of the urn resting against the soft cushion 22 on the rear wall of the chamber 21, with the adhering surfaces 32 of the two positioning members 3 coated with glue or adhesive and adhered on the inner surfaces two sidewalls of the case body 2. Thus, the two embracing surfaces 31 of the positioning members 3 embrace the two sides of a bone-ashes urn 12, with the thick palm portions 311 narrowing the front opening of the chamber 21 of the case body 2 so as to stabilize the urn 12 by stopping the front side of the urn 12 from moving out. Lastly, the faceplate 13 is fixed to close up the front opening of the chamber 21. Thus, even in case of an earthquake, the bone-ashes urn 12 is closely and stably embraced by the two positioning members 3 keeping the urn 12 from swaying or inclining as to protect the urn 12 from getting damaged so that the soul of the deceased may not be disturbed, and remain calm and comfortable.

Figure 4:
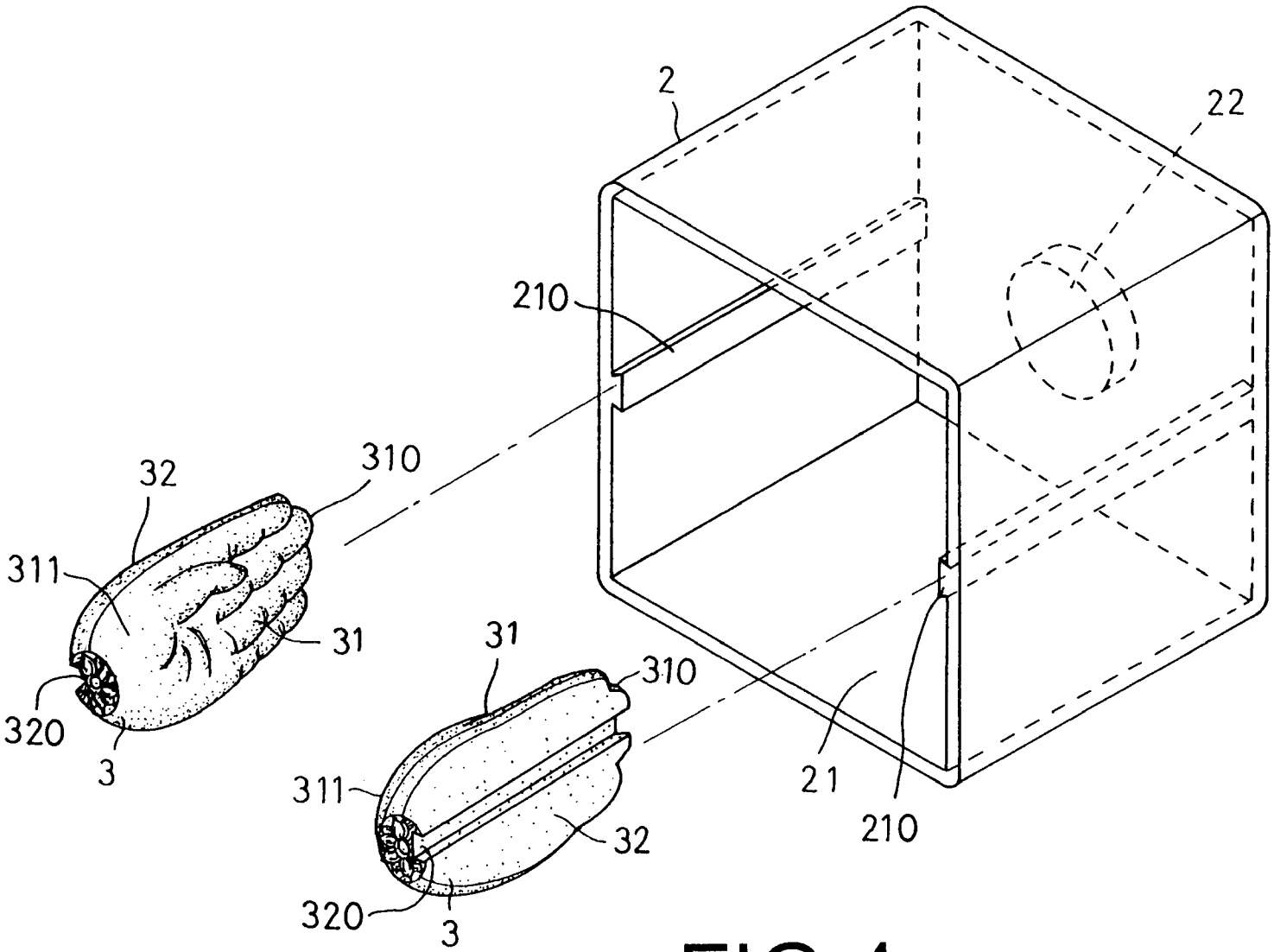
FIG. 4 is a second embodiment of a bone-ashes urn preserving case in the present invention; and, FIG. 5 is an upper view of the second embodiment of a bone-ashes urn preserving case in the present invention, showing a bone-ashes urn being kept therein.
Figure 5:
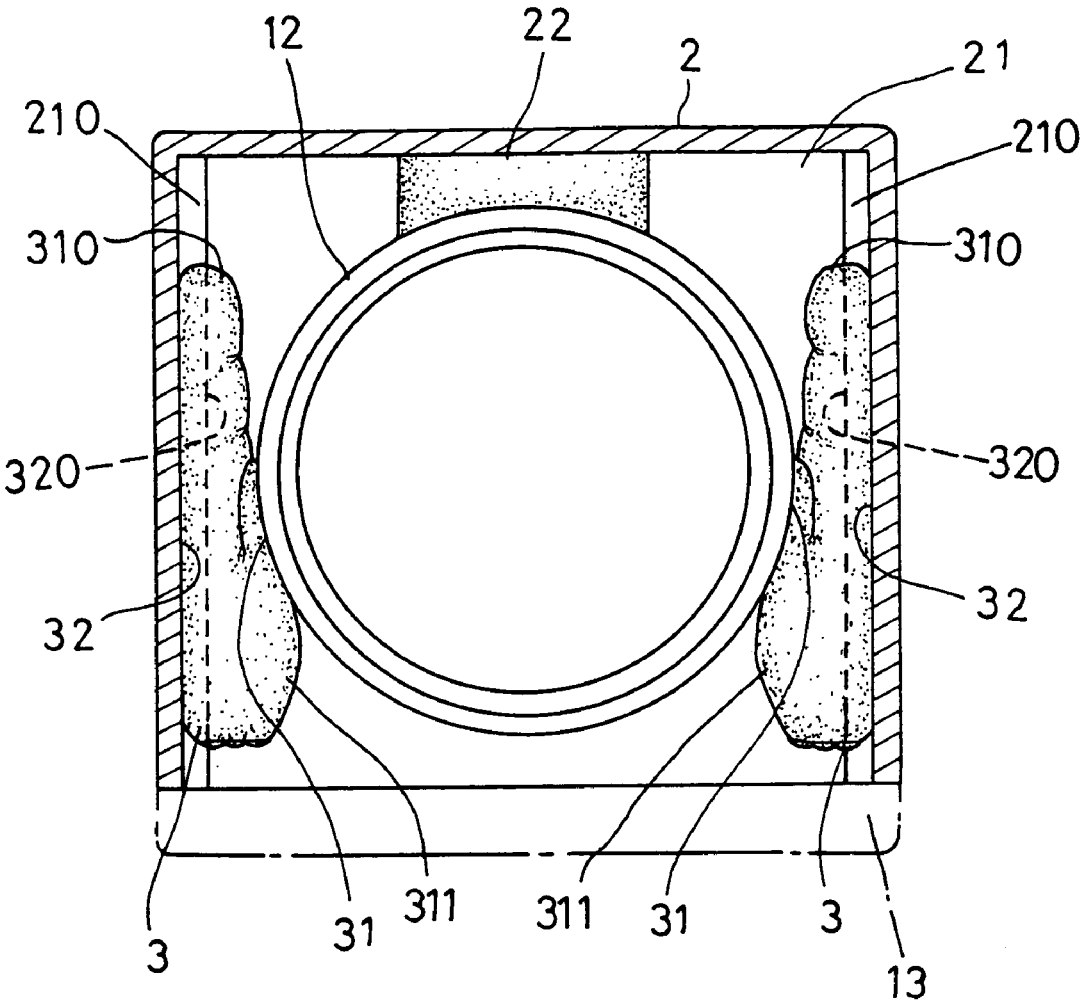

Next, FIGS. 4 and 5 show a second embodiment of a bone-ashes urn preserving case, which has nearly the same structure as the first embodiment except that an elongate horizontal inserting projection 210 additionally formed on an inner center surface of each of two opposite sidewalls of the case body 2, and an elongate horizontal insert groove 320 formed in an outer surface of the adhering surface 32 of each positioning member 3 to correspondingly fitting with each elongate insert projection 210, without adhering the positioning members 3 on the sidewalls of the case body 2.

In using the second embodiment, a bone-ashes urn 12 is placed in the chamber 21 of the case body 2, with the rear side of the urn 12 resting against the soft cushion 22 fixed on the rear wall of the chamber 21. Then the two positioning members 3 are combined respectively with the two sidewalls of the case body 2 by pushing and fitting the elongate insert projections 210 in the elongate grooves 320 of the positioning members 3, with the thick palm portions 311 narrowing the front opening of the chamber 21 of the case body 2, and with the embrace surface 31 closely embracing the two sides of the urn 12 as to stabilize the urn 12 in the immovable condition as does the first embodiment.

The invention has the following advantages, as can be seen from the foresaid description.

1. The positioning members are easily assembles with the case body.

2. The thick front portion of the positioning members can narrow the front opening of the chamber of the case body, with the palm portion embracing the two sides of the bone-ashes urn, keeping the urn from taken or sliding out.

3. The positioning members and the soft cushion can surround softly and resiliently a bone-ashes urn to prevent the urn from swaying or inclining to cause possible damage even in case of an earthquake.

While the preferred embodiments have been described above, it will be recognized and understood that various modifications may be made therein and the appended claimed are intended to cover all such modifications that may fall within the spirit and scope of the invention.

The invention claimed is:

1. A bone-ashes urn preserving case comprising a case body, said case body defining a chamber in its interior, said chamber having a soft cushion attached on an inner surface of a rear wall, two positioning members respectively attached on an inner surface of two opposite sidewalls of said case body, each said positioning member shaped as a palm with five closely-positioned fingers and having an inner surface functioning as an embracing surface and an outer surface functioning as an attaching surface, the palm portion of each said positioning member having a rather large thickness, and said finger portion having a rather thin thickness, said large thickness of said palm portion narrowing a front opening of said chamber; and, said embracing surface of each said positioning member respectively closely embracing two sides of a bone-ashes urn, said soft cushion resting against a rear side of the bone-ashes urn when the bone-ashes urn is placed in said case body, thus the bone-ashes urn never swaying or inclining to get damaged or broken even in case of an earthquake after being positioned in said case body.

2. The bone-ashes urn preserving case as claimed in claim 1, wherein the inner surface of each of the two opposite sidewalls of said chamber of said case body is provided with an elongate horizontal insert projection, and said positioning members are respectively provided with an elongate horizontal groove on said attaching surfaces for said elongate horizontal insert projections to fit in for combining said positioning members with said case body without adhering said positioning members to said case body.

3. The bone-ashes urn preserving case as claimed in claim 1, wherein said soft cushion and said positioning members are made of soft flexible plastic.

4. The bone-ashes urn preserving case as claimed in claim 1, wherein said positioning members are adhered respectively on said inner surface of said two opposite sidewalls of said case body.

* * * * *